US009664391B2

(12) United States Patent
Kobayashi et al.

(10) Patent No.: US 9,664,391 B2
(45) Date of Patent: May 30, 2017

(54) GAS TURBINE COMBUSTOR

(71) Applicants: KAWASAKI JUKOGYO KABUSHIKI KAISHA, Kobe-shi, Hyogo (JP); JAPAN AEROSPACE EXPLORATION AGENCY, Chofu-shi, Tokyo (JP)

(72) Inventors: Masayoshi Kobayashi, Kobe (JP); Takeo Oda, Kobe (JP); Ryusuke Matsuyama, Akashi (JP); Atsushi Horikawa, Akashi (JP); Hitoshi Fujiwara, Chofu (JP)

(73) Assignees: KAWASAKI JUKOGYO KABUSHIKI KAISHA, Hyogo (JP); JAPAN AEROSPACE EXPLORATION AGENCY, Tokyo (JP)

( * ) Notice: Subject to any disclaimer, the term of this patent is extended or adjusted under 35 U.S.C. 154(b) by 607 days.

(21) Appl. No.: 14/091,619

(22) Filed: Nov. 27, 2013

(65) Prior Publication Data

US 2014/0083105 A1 Mar. 27, 2014

Related U.S. Application Data

(63) Continuation of application No. PCT/JP2012/064271, filed on Jun. 1, 2012.

(30) Foreign Application Priority Data

Jun. 2, 2011 (JP) ..... 2011-124072

(51) Int. Cl.
*F23R 3/28* (2006.01)
*F23R 3/16* (2006.01)
(Continued)

(52) U.S. Cl.
CPC ..... *F23R 3/28* (2013.01); *F23R 3/14* (2013.01); *F23R 3/16* (2013.01); *F23R 3/18* (2013.01);
(Continued)

(58) Field of Classification Search
CPC ..... F23R 3/14; F23R 3/286; F23R 3/343
See application file for complete search history.

(56) References Cited

U.S. PATENT DOCUMENTS 2,800,768 A 7/1957 Wheeler
3,703,259 A 11/1972 Sturgess et al.
(Continued)

FOREIGN PATENT DOCUMENTS

CN 101818910 A 9/2010
GB 2 099 978 A 12/1982
(Continued)

OTHER PUBLICATIONS

Communication dated Sep. 25, 2014 from the European Patent Office in counterpart application No. 12793375.2.
(Continued)

*Primary Examiner* — Gerald L Sung
*Assistant Examiner* — William Breazeal
(74) *Attorney, Agent, or Firm* — Sughrue Mion, PLLC

(57) ABSTRACT

An annular type gas turbine combustor having a plurality of fuel nozzle assemblies (10) on a circumference includes a pilot nozzle unit (12) for spraying a fuel for diffusive combustion from a pilot outer peripheral nozzle (34) into a combustion chamber (8), a main nozzle unit (14) provided so as to surround the pilot nozzle unit (12) for spraying a fuel for premix combustion, and a flow guide (27) disposed on a downstream side of each of the fuel nozzle assemblies (10) and having a sectional area of a passage for air and air-fuel
(Continued)

mixture from each of the fuel nozzle assemblies (10), which gradually increase in a downstream direction.

8 Claims, 6 Drawing Sheets

(51) Int. Cl.

| | |
|---|---|
| ***F23R 3/18*** | (2006.01) |
| ***F23R 3/34*** | (2006.01) |
| ***F23R 3/50*** | (2006.01) |
| ***F23R 3/14*** | (2006.01) |

(52) U.S. Cl.
CPC ..... *F23R 3/286* (2013.01); *F23R 3/343* (2013.01); *F23R 3/50* (2013.01)

(56) References Cited

U.S. PATENT DOCUMENTS

| | | | | |
|---|---|---|---|---|
| 3,866,413 | A | 2/1975 | Sturgess | |
| 4,854,127 | A | 8/1989 | Vinson et al. | |
| 5,323,604 | A | 6/1994 | Ekstedt et al. | |
| 5,970,716 | A | 10/1999 | Forrester et al. | |
| 6,381,964 | B1 | 5/2002 | Pritchard, Jr. et al. | |
| 7,779,636 | B2 | 8/2010 | Buelow et al. | |
| 8,172,568 | B2 | 5/2012 | Kashihara et al. | |
| 2006/0248898 | A1* | 11/2006 | Buelow | F23R 3/14 60/776 |
| 2007/0028624 | A1* | 2/2007 | Hsieh | F23R 3/14 60/776 |
| 2008/0289340 | A1* | 11/2008 | Oda | F23R 3/28 60/737 |
| 2009/0113893 | A1* | 5/2009 | Li | F23R 3/14 60/737 |
| 2010/0136496 | A1 | 6/2010 | Kashihara et al. | |
| 2012/0204571 | A1* | 8/2012 | Kraemer | F23D 14/48 60/776 |

FOREIGN PATENT DOCUMENTS

| | | | |
|---|---|---|---|
| JP | 57-192729 | A | 11/1982 |
| JP | 01182530 | A | 7/1989 |
| JP | 8-500178 | A | 1/1996 |
| JP | 11-159759 | A | 6/1999 |
| JP | 2002-115847 | A | 4/2002 |
| JP | 2003-534516 | A | 11/2003 |
| JP | 2006-313064 | A | 11/2006 |
| WO | 94/29647 | A1 | 12/1994 |
| WO | 01/90652 | A1 | 11/2001 |
| WO | 2009022449 | A1 | 2/2009 |

OTHER PUBLICATIONS

International Preliminary Report on Patentability for PCT/JP2012/064271, dated Dec. 12, 2013.

International Search Report for PCT/JP2012/064271 dated Jul. 10, 2012.

Communication dated Mar. 22, 2016 from the Japanese Patent Office in counterpart application No. 2013-518186.

Communication dated Oct. 4, 2016, from the Japanese Patent Office in counterpart application No. 2013-518186.

* cited by examiner

RELATED ART

GAS TURBINE COMBUSTOR

CROSS REFERENCE TO THE RELATED APPLICATION

This application is a continuation application, under 35 U.S.C §111(a) of international application No. PCT/JP2012/064271, filed Jun. 1, 2012, which claims priority to Japanese patent application No. 2011-124072, filed Jun. 2, 2011, the entire disclosure of which is herein incorporated by reference as a part of this application.

BACKGROUND OF THE INVENTION (Field of the Invention)

The present invention relates to an annular type gas turbine combustor of a kind having a plurality of fuel nozzle assemblies disposed on a circumference (or in a round row).

(Description of Related Art)

In recent years, in the light of the pressing environmental concerns, the reduction of noxious substances such as, for example, NOx (nitrogen oxides) emitted from gas turbines is increasingly demanded and, in order to meet with this demand, development of a lean combustor have now been taken place. The lean combustor is of a type capable of forming a leaned air-fuel mixture by allowing half or more of the air, then flowing into the combustor, to flow through fuel nozzle assemblies. As leaned fuel nozzle assemblies of the lean combustor, concentric fuel nozzle assemblies are used in which combustion takes place at all of operating points, including ignition by means of pilot fuel nozzle assembly disposed at a center portion of the leaned fuel nozzle assemblies, and a low NOx combustion is accomplished by a main fuel nozzle assembly, disposed radial outside of the pilot fuel nozzle assembly, at an output exceeding an intermediate output. In this respect, see the patent document 1 listed below.

In general, ignition in the combustor takes place in the following sequence. At the outset, a spark of an ignition plug is captured into a circulation region formed downstream of one of the fuel nozzle assemblies to thereby form a flash point. Then, the flash point is propagated within the circulation region in an upstream direction and such one of the fuel nozzle assemblies is ignited to form a flame within the circulation region. Thereafter, the flame is propagated to a circulation region formed downstream of the neighboring fuel nozzle assembly. The flame is propagated to all of the fuel nozzle assemblies and the ignition completes with the flame stabilized and maintained.

PRIOR ART LITERATURE

[Patent Document 1] JP Laid-open Patent Publication No. 2006-313064

It has, however, been found that in the lean combustor of the kind referred to above 50 to 80% of the total inflow air, inclusive of the air flowing from an air hole in a combustion barrel, is allowed to flow through the fuel nozzle assemblies, and therefore, as compared with the conventional combustor in which only about 15% of the air is allowed to flow through the fuel nozzle assemblies, there is a risk that the average flow velocity in an upstream of a combustion chamber, which is in the vicinity of the fuel nozzle assemblies, may become high and the flash point will no longer be propagated in an upstream direction. Also, in order to create a uniform air-fuel mixture, the air flowing into the combustion chamber is given a strong swirl. Accordingly, if in the annular type gas turbine combustor, the flow velocity within the upstream region in the combustion chamber becomes high, there is a risk that, as shown in FIG. 6, swirling air streams 100 from the neighboring fuel nozzle assemblies will interfere with each other enough to fail to form a stable circulation region and, moreover, swirling flows (large scale swirling flows) 102 and 104, which are reverse to each other on an inner diametric side and an outer diametric side of the combustor, will be generated enough to deform a circulation region 106 on a downstream side immediately below the fuel nozzle assemblies. As discussed above, if the flash point is not propagated in the upstream direction within the circulation region and/or no stable circulation region is formed, the ignitability of the combustor will be lowered.

SUMMARY OF THE INVENTION

In view of the foregoing problems and inconveniences, the present invention has been devised to provide an annular type gas turbine combustor having a plurality of fuel nozzle assemblies disposed on a circumference (in a round row), in which the ignitability can be increased.

In order to accomplish the foregoing object, the present invention provides an annular gas turbine combustor having a plurality of fuel nozzle assemblies disposed on a circumference. The gas turbine combustor includes a flow guide mounted on a downstream side of the fuel nozzle assembly and having a sectional area of a passage for an air and an air-fuel mixture from the fuel nozzle assembly, which sectional area is gradually increased towards the downstream side. In this gas turbine combustor, each of the fuel nozzle assemblies includes a first fuel injection unit to spray a fuel from a spraying nozzle into a combustion chamber, and a second fuel injection unit provided so as to surround the first fuel injection unit and operable to spray a fuel.

According to the above described construction, since the flow guide gradually flaring toward a downstream side is disposed on the downstream side of the fuel nozzle assembly, a swirling air outflowing from the fuel nozzle assembly is directed to flow along the inner peripheral surface of the flow guide and does hence expand properly radially outwardly of the fuel nozzle assembly. Accordingly, the circulation region formed radially inwardly expands radially outwardly to increase the volume. As a result thereof, the spark occurring in the ignition plug can be easily captured into the circulation region to facilitate the formation of the flash point. Also, the flow of the air current along the inner peripheral surface of the flow guide results in an increase of the volume as a result of the radially outward expansion of the circulation region. Accordingly, the distance between the circulation regions of the neighboring fuel nozzle assemblies is reduced and, hence, flames can be easily propagated to the circulation region formed in the neighboring fuel nozzle assembly.

Also, since the provision of the flow guide in the manner as hereinabove described is effective to suppress the interference between the swirling air streams from the neighboring fuel nozzle assemblies and, at the same time, the massive swirling flow as hereinabove described is not formed in that portion where the flow guide is provided, neither the reduction nor the deformation of the circulation region is avoided to allow the stable circulation region to be formed. In addition, as the air stream flows along the inner peripheral surface of the flow guide then fixed, no influence brought about by eddies (corner flow) produced outside of the air stream is received and, therefore, the stable circulation region is easily formed. As a result thereof, the ignitability increases.

In a preferred embodiment of the present invention, the flow guide has a transverse sectional shape that is round and has an upstream end of an inner diameter which is equal to or somewhat greater than an air outlet diameter of the fuel nozzle assembly. According to this construction, since the diameter of the upstream end of the flow guide and the air outlet diameter of the fuel nozzle assembly are substantially equal values, the separation of the air stream emerging outwardly from the fuel nozzle assembly can be minimized. Also, as the inner diameter of the upstream end of the flow guide is made somewhat greater than the air outlet caliber of the fuel nozzle assembly, even when the fuel nozzle assembly is displaced in the radial direction as a result of the thermal expansion taking place in such fuel nozzle assembly, such displacement can be absorbed.

In another preferred embodiment of the present invention, the flow guide has a conical portion of a shape flared in a conical shape from the upstream side towards the downstream side. Having the conical shape is particularly advantageous in suppressing the occurrence of a flow separation from a flow guide surface at a location downstream of the fuel nozzle assembly and in maintaining the swirling flow. As a result, the stable circulation region can advantageously be formed. In such case, if the angle of the conical portion relative to an axis of the fuel nozzle assembly is chosen to be within the range of 25 to 50°, a possible separation between the swirling flow and the flow guide can be suppressed.

Where the flow guide has the conical portion referred to hereinabove, the flow guide preferably has a cylindrical portion continued with a downstream end of the conical portion. Here, the cylindrical portion suffices to extend substantially parallel to the axis of the fuel nozzle assembly and may be of a shape somewhat converged or constricted towards the downstream side.

According to this construction, as a result that an excessive expansion in a direction radially of the circulation region is suppressed by the cylindrical portion, the interference between the circulating flows from the neighboring fuel nozzle assemblies is further suppressed, resulting in the increase of the ignitability.

Where the flow guide has the conical portion referred to above, the conical portion of the flow guide preferably has a downstream end of an outer diameter substantially coinciding with a radial width of the combustion chamber that is formed inside of the combustor. According to this construction, as the air stream expands considerably in the radially outward direction along the conical portion of the flow guide, the circulation region expands considerably in the radially outward direction. As a result thereof, the formation of the flash point is facilitated.

In a further preferred embodiment of the present invention, the flow guide has a downstream end positioned at a location upstream of a maximum diameter portion of a circulation region. According to this construction, since propagation of the flames towards the neighboring fuel nozzle assembly takes place smoothly through the maximum diameter portion of the circulation region, the ignitability is further increased.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF PREFERRED EMBODIMENTS

Figure 1:
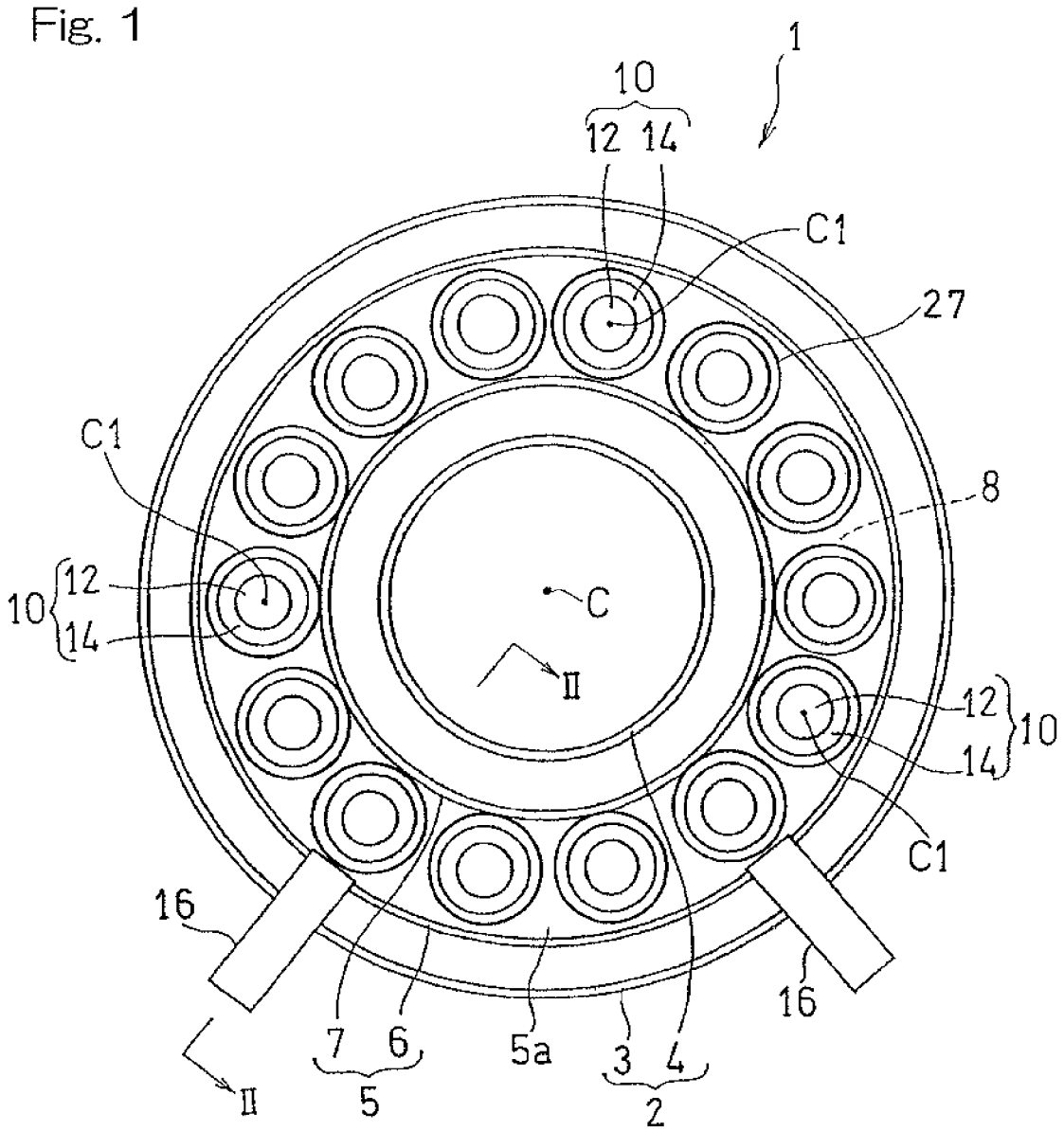
FIG. 1 is a schematic front elevational view showing a combustor for a gas turbine engine in accordance with a preferred embodiment of the present invention.

With reference to the accompanying drawings, the present invention will now be described in detail in connection with a preferred embodiment thereof. FIG. 1 illustrates a head portion of a combustor 1 employed in a gas turbine engine designed in accordance with the preferred embodiment of the present invention. The combustor 1 burns an air-fuel mixture, which has been formed by mixing fuel with a compressed air supplied from a compressor (not shown) of the gas turbine engine, to produce high temperature, high pressure combustion gases and then to supply the combustion gases to a turbine to drive the latter.

The combustor 1 is of an annular type including an annular outer casing 3 and an annular inner casing 4 positioned inside of the annular outer casing 3, which outer and inner casings 3 and 4 are disposed in a coaxial relation with an engine longitudinal axis C to define a combustor housing 2 having an annular interior compartment defined therein. Within the annular interior compartment of the combustor housing 2, a combustion case 5 having an annular inner liner 7 coaxially positioned inside of an annular outer liner 6 is disposed in a coaxial relation with the combustor housing 2. The combustion case 5 has an annular combustion chamber 8 defined therein, and a plurality of fuel nozzle assemblies 10 for injecting fuel into the combustion chamber 8 are disposed on a top wall 5*a* of the combustor case 5 in a round row coaxial with the combustor case 5 and are spaced from each other circumferentially equidistantly about the engine longitudinal axis C. Each of the fuel nozzle assemblies 10 includes a pilot nozzle unit 12, which is a first fuel injection unit and which is positioned on a nozzle axis C1, and a main nozzle unit 14 which is a second fuel injection unit and which is provided coaxially with the pilot nozzle unit 12 so as to surround the latter. In the illustrated embodiment, the pilot nozzle unit 12 is of a diffusive combustion system and the main nozzle unit 14 is of a premix combustion system, but they may not be necessarily limited thereto.

Two ignition plugs 16 are provided so as to extend through the outer casing 3 and the outer liner 6 in a direction radially of the combustion case 5 with their tip ends confronting the adjacent fuel nozzle assemblies 10. Accordingly, in this combustor 1, combustible air-fuel mixtures fed respectively from the two fuel nozzle assemblies 10, which confronts the associated ignition plugs 16, are first ignited, and flames produced as a result of combustion of the air-fuel mixtures are propagated in sequence from the neighboring fuel injection device valves 10, with the combustible air-fuel mixture from all of the fuel nozzle assemblies 10 being ignited consequently.

Figure 2:
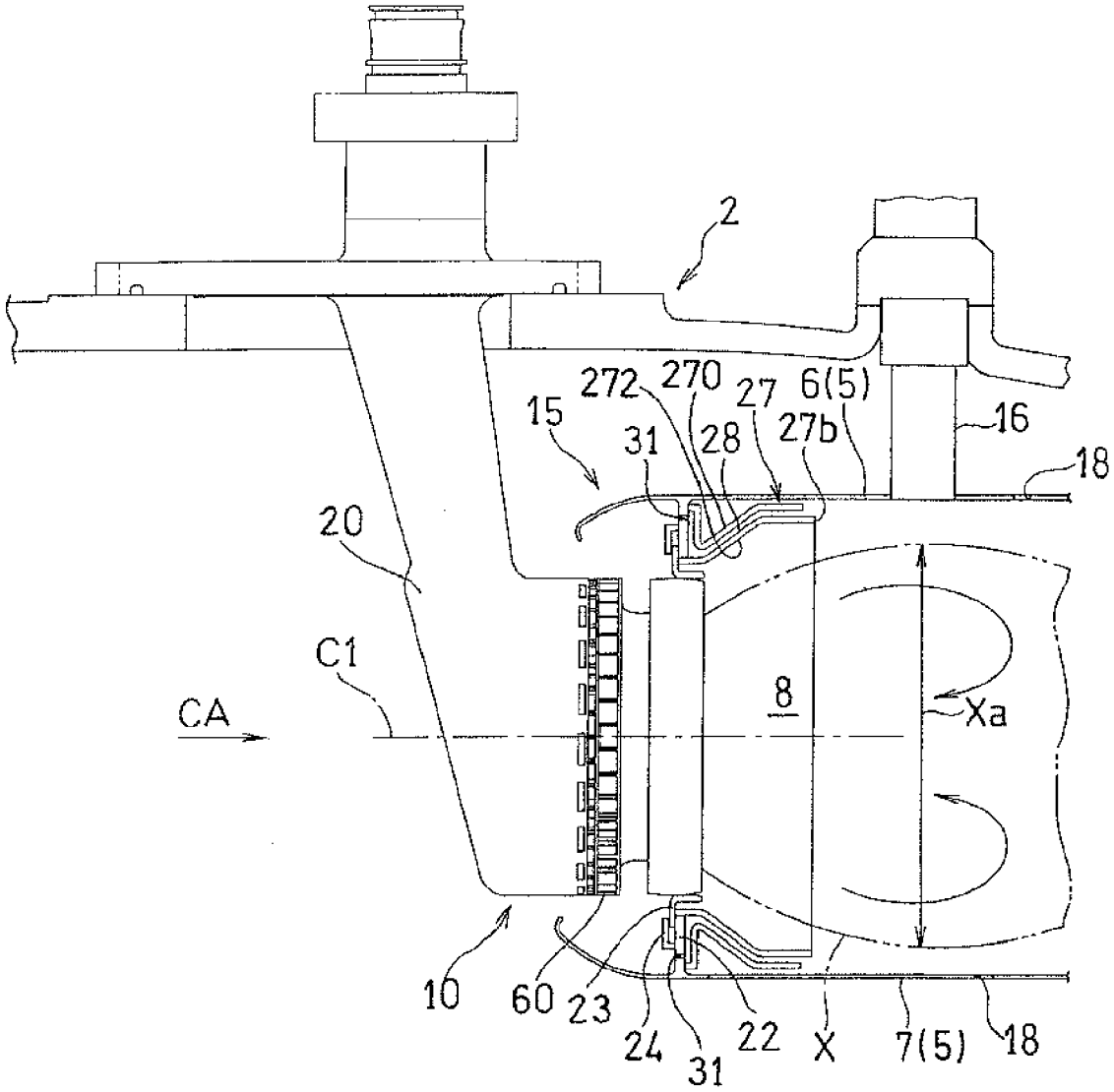
FIG. 2 is a cross sectional view taken along the line II-II in FIG. 1.

FIG. 2 illustrates an enlarged longitudinal sectional view taken along the line II-II in FIG. 1. Within the annular interior compartment of the combustor housing 2, the compressed air CA supplied from the compressor is introduced through an air intake tube (not shown), and the compressed air CA so introduced is supplied to the fuel nozzle assemblies 10 and also to the combustion chamber 8 through a plurality of air holes 18 that are defined in the outer and inner liners 6 and 7 of the combustion case 5. Each of the fuel nozzle assemblies 10 is supported by the outer casing 3 of the combustor housing 2 by means of a corresponding stem member 20.

Each of the fuel nozzle assemblies 10 is supported by the head portion of the combustor case 5 by means of the following structure. An annular cowling 15 coaxial with the annular outer and inner liners 6 and 7 is fixed to respective head portions of the annular outer and inner liners 6 and 7. A support body 22, which is called a "dome", is provided inside of a rear portion of the cowling 15. On the other hand, an annular flange 23 coaxial with the nozzle axis C1 is fitted to a rear portion of each of the fuel nozzle assemblies 10 and is engaged between the dome (support body) 22 and an engagement piece 24, fitted to the dome, for movement in a radial direction. In this way, each of the fuel nozzle assemblies 10 is supported by the combustor case 5.

The combustion case 5 has its outer liner 6 supported by the outer casing 3 by means of a support member (not shown). The combustion case 5 has a downstream end portion connected with a first stage nozzle of the turbine which is also not shown.

The dome 22 has a flow guide 27 fitted thereto. As will be detailed later, the flow guide 27 is a member for guiding the air and the air-fuel mixture from the corresponding fuel nozzle assembly 10 towards the combustion chamber 8. The flow guide 27 has an interior of a double walled structure that is coaxial with the nozzle axis C1, and a coolant passage 28 for flowing the compressed air CA as a cooling medium is formed in the interior of the flow guide 27. The dome 22 is formed with a plurality of introduction holes 31 defined therein for introducing the compressed air CA into the coolant passage 28, which is formed between outer and inner peripheral walls 270 and 272 of the flow guide 27, and those introduction holes 31 are disposed in a round row coaxial with the nozzle axis C1.

Figure 3:
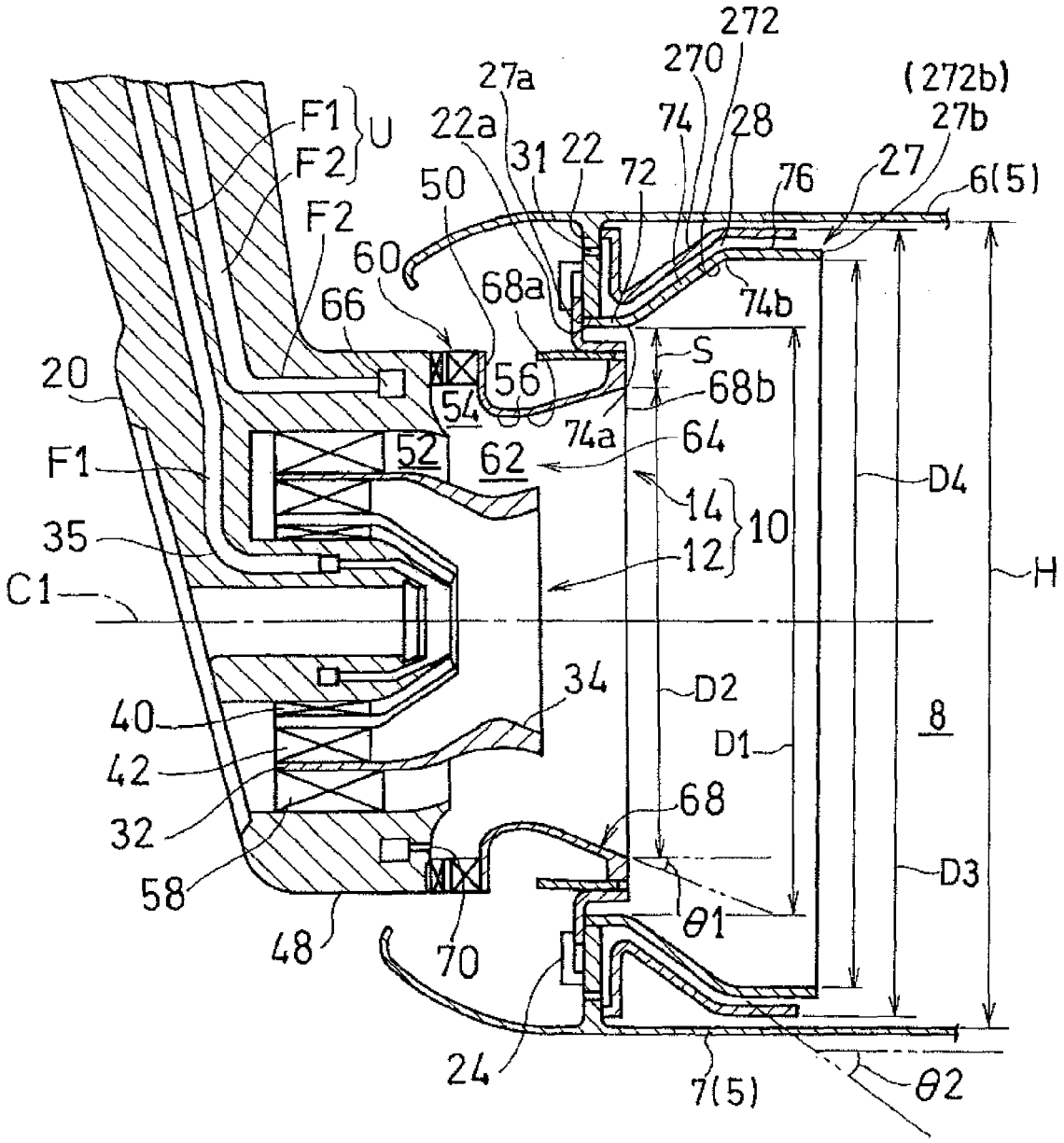
FIG. 3 is a longitudinal sectional view showing, on an enlarged scale, fuel nozzle assemblies of the combustor.

FIG. 3 illustrates a longitudinal sectional view of each of the fuel nozzle assemblies 10 in detail. The stem member 20 referred to previously forms a part of a fuel piping unit U, and this fuel piping unit U includes a first fuel supply system F1 for supplying the fuel to the pilot nozzle unit 12 and a second fuel supply system for supplying the fuel to the main fuel nozzle assembly 14. The pilot nozzle unit 12 provided at a center portion of the respective fuel nozzle assembly 10 includes a pilot fuel injector 35 having an injection port through which a pilot fuel from the first fuel supply system F1 is injected, a pilot outer peripheral nozzle 34 in the form of a Venturi nozzle for spraying the fuel from the pilot fuel injector 35 into the combustion chamber 8, and two inner and outer swirlers 40 and 42 coaxial with the nozzle axis C1. The outer swirler 42 is disposed inwardly of an inner shroud 32. The pilot outer peripheral nozzle 34 is defined by a portion of an inner peripheral surface of the inner shroud 32 downstream of the outer swirler 42.

The main nozzle unit 14 mounted around an outer periphery of the pilot nozzle unit 12 includes a ring area 48, positioned radially outwardly of the inner shroud 32 in a coaxial relation with the inner shroud 32 and connected with the stem member 20, and an outer shroud 50 disposed on an axial downstream side of the ring area 48. An annular first air flow passage 52, which is an inflow passage for introducing the air in an axial direction, is defined intermediate between the inner shroud 32 and the ring area 48. An annular second air flow passage 54, which is an inflow passage for introducing the air in a radial direction, is defined intermediate between the ring area 48 and the outer shroud 50. In other words, a downstream end face of the ring area 48 forms one side wall of the second air flow passage 54 and an upstream portion of an inner peripheral surface 56 of the outer shroud 50 forms the opposite side wall of the second air flow passage 54. The first air flow passage 52 and the second air flow passage 54 are divided from each other by the ring area 48.

An inlet of the first air flow passage 52 has a main inner swirler 58 mounted therein, and the second air flow passage 54 has a main outer swirler 60 mounted therein. Also, at a location downstream of the first and second air flow passages 52 and 54, a mixing chamber 62, in which flows from those air flow passages 52 and 54 are merged together, is defined intermediate between the outer shroud 50 and the inner shroud 32. A main passage 64 is constituted by three portions, that is, the first air flow passage 52, the second air flow passage 54 and the mixing chamber 62.

Within an interior of the ring area 48 dividing the first and second air flow passages 52 and 54 from each other, an annular main fuel injector 66 communicated with the second fuel supply system F2 is formed. To the main nozzle unit 14, no fuel is supplied during a low power operation, but the fuel is supplied from the second fuel supply system F2 only during an intermediate power operation and a high power operation. The main fuel injector 66 injects the fuel from the plurality of the main fuel injection ports 70 only into the second air flow passage 54. The fuel so injected is mixed together with an air stream from the main outer swirler 60 and an air stream from the main inner swirler 58 within the mixing chamber 62 to form the air-fuel mixture, which mixture is subsequently supplied into and then combusted within the combustion chamber 8. During the low power operation in which no fuel is supplied to the main nozzle unit 14, main air streams having passed through the swirlers 58 and 60 are supplied to the combustion chamber 8 through the mixing chamber 62.

A downstream portion of the inner peripheral surface 56 of the outer shroud 50 forms a main outlet flare 68 of the main nozzle unit 14. This main outlet flare 68 is so shaped as to extend from a base end portion 68*a*, which is an upstream end and which is most inwardly bulged in a radial direction, towards an outlet end 68*b*, which is a downstream end, so as to flare outwardly. The angle of inclination θ1 of the main outlet flare 68 relative to the nozzle axis C1 is about 35°, but is preferably within the range of 20 to 50°. A transverse sectional surface of the main outlet flare 68 at right angles to the nozzle axis C1 is round.

The annular flow guide 27 coaxial with the nozzle axis C1 as referred to previously is disposed outwardly of the main outlet flare 68. More specifically, the flow guide 27 has a transverse sectional surface of a round shape also similar to that of the outlet end 68*b* of the main outlet flare 68. A substantially cylindrical mounting portion 72, formed in an upstream end portion of the flow guide 27, is so disposed as to enclose the outside of the outlet end 68*b* of the main outlet flare 68 through a radial gap S intervening between it and the outlet end 68*b*, with an outer peripheral surface of the mounting portion 72 supported by a tip end (inner end) 22*a* of the dome 22. In other words, an upstream end 27*a* of the flow guide 27 has an inner diameter D1 which is somewhat greater than an inner diameter D2 of the outlet end 68*b* of the main outlet flare 68, which is an air outlet diameter of the fuel nozzle assembly 10. It is, however, to be noted that the diameter D1 of the upstream end 27*a* of the flow guide 27 may be substantially equal to the air outlet diameter D2 of the fuel nozzle assembly 10.

The flow guide 27 referred to above includes a conical portion 74, which is so shaped as to flare in a conical shape from the mounting portion 72 at the upstream end portion thereof towards a downstream side thereof, and a cylindrical portion 76 continued from a downstream end 74*b* of the conical portion 74 so as to substantially parallel to the nozzle axis C1 while extending towards a downstream side thereof. In other words, the flow guide 27 is of such a shape as to gradually increase the sectional area of a passage for the air and the air-fuel mixture from the fuel nozzle assembly 10 in a downstream direction and then to fit in or to halt increasing. Also, in the embodiment now under discussion, the cylindrical portion 76 referred to above has been shown and described as extending towards the downstream side in substantially parallel relation with the nozzle axis C1, but the cylindrical portion 76 may be of any suitable shape provided that the increase of the sectional area of that passage may fit in and, accordingly, may be of a shape somewhat pinched or converged on the downstream side. As shown in FIG. 2, the downstream end 27*b* of the flow guide 27 is positioned upstream of a maximum diameter portion Xa of the circulation region X and the ignition plugs 16.

The conical portion 74 of the flow guide 27 best shown in FIG. 3 flares in a region between the upstream end 74*a* and the downstream end 74*b* thereof, in which no fluid separation take place, and the position of the upstream end 74*a* in a direction conforming to the nozzle axis C1 is set to a position that is substantially the same as or somewhat downstream of the outlet end 68*b* of the main outlet flare 68 of the main nozzle unit 14. The downstream end 74*b* of the conical portion 74 has an outer diameter D3 which is substantially equal to the radial width of the combustion chamber 8 (the radial distance between the inner peripheral surfaces of the outer liner 6 and the inner liner 7) H, which is called "height" of the combustor 1, that is, the maximum width which one of the fuel nozzle assembly 10 can occupy. The outer diameter D3 of the downstream end 74*b* is so chosen as to be 0.9H or more, preferably 0.93H or more and more preferably 0.95H or more. When the outer diameter D3 of the downstream end 74*b* of the conical portion 74 is increased as described above, the inner diameter D4 of a downstream end 272*b* of an inner peripheral wall 272 is increased correspondingly. Hence, the air and the air-fuel mixture from the fuel nozzle assembly 10, which flow along an inner peripheral surface of the conical portion 74 of the flow guide 27, can be expanded radially outwardly.

Also, in the embodiment now under discussion, the angle θ2 of the conical portion 74 relative to the nozzle axis C1 is chosen to be about 45°. The angle θ2 is preferably within the range of 25 to 50° and more preferably within the range of 35 to 48°. If the angle θ2 is smaller than the lowermost limit of 25°, the air and the air-fuel mixture from the fuel nozzle assembly 10 cannot be properly expanded radially outwardly. Also, if the angle θ2 exceeds the uppermost limit of 50°, a portion of the air and the air-fuel mixture from the fuel nozzle assembly 10 will separate from the conical portion 74.

In the construction described above, the air and the air-fuel mixture having passed the pilot nozzle unit 12 diffuse towards an outer peripheral side because of their swirling flow. In the mixed stream immediately after the outlet of the fuel nozzle assembly 10, because of a strong swirling flow of the air mainly emerging from the main nozzle unit 14, a negative pressure is developed in the vicinity of the nozzle axis C1, and a pressure distribution in a radially inward direction and an outwardly oriented centrifugal force are counterbalanced with each other. However, since the strong swirling air stream emerging from the main nozzle unit 14 gradually flares toward a downstream side, and is gradually attenuated enough to weaken the swirling motion, the pressure in the vicinity of the nozzle axis C 1 gradually retrieves as it goes towards the downstream side. Accordingly, on a point of the nozzle axis C1 downstream of the fuel nozzle assembly 10, a high adverse pressure gradient, in which the pressure is higher at the downstream side than at the upstream side, occurs and, hence, as shown in FIG. 2, the circulation region X, in which a reverse flow from the downstream side towards the upstream side on the nozzle axis C1, is formed.

Figure 4A:
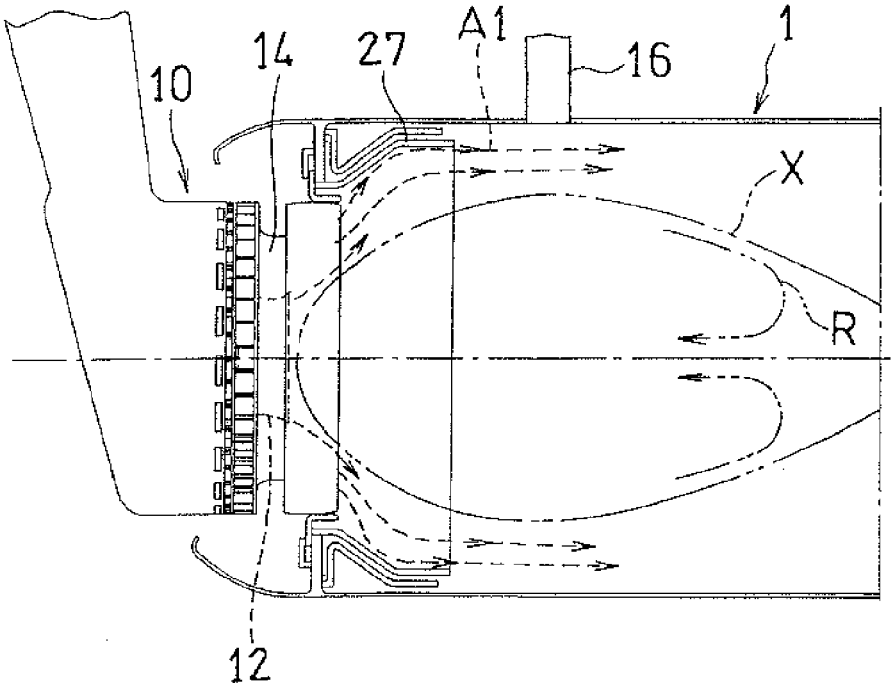
FIG. 4A is a computerized analytical diagram showing the flow of a fluid in the combustor.

As shown in FIG. 4A, the swirling air stream A1 flowing outwardly from the main nozzle unit 14 flows along the inner peripheral surface of the flow guide 27 and is then properly flared radially outwardly. Accordingly, the circulation region X formed radially inwardly expands radially outwardly, accompanied by an increase of the volume. Also, the flow of the air stream along the inner peripheral surface of the flow guide 27 in the manner described above results in formation of a reverse flow region R in an axial center portion in the vicinity of the outlet of the fuel nozzle assembly 10.

Figure 4B:
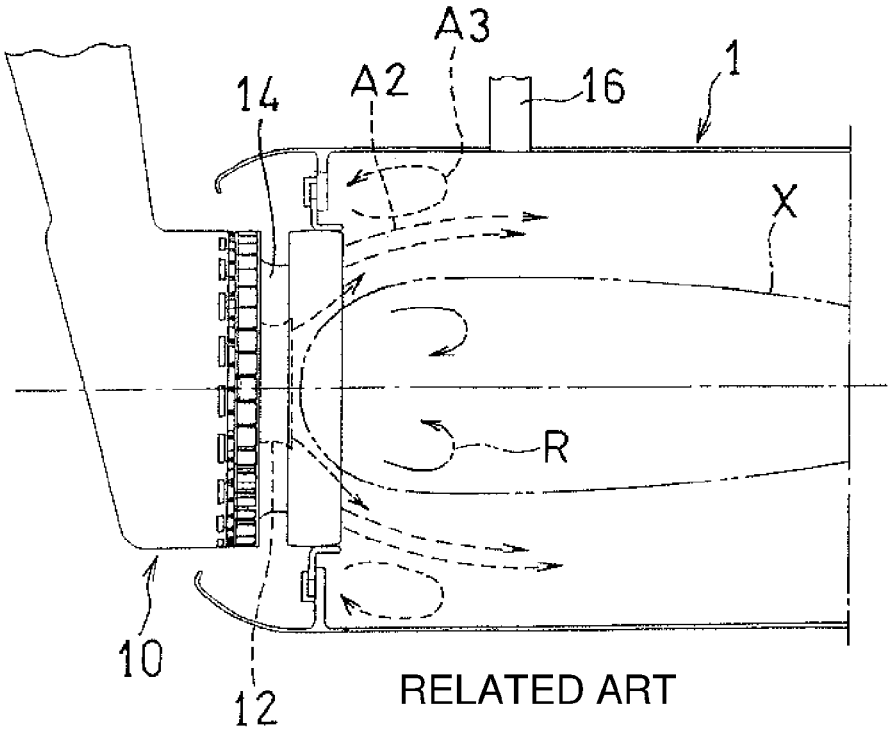
FIG. 4B is a computerized analytical diagram showing the flow of the fluid in the combustor which is not equipped with a flow guide.

On the other hand, in the combustor of a type having no flow guide used therein, as shown in FIG. 4B, an air stream A2 flowing outwardly from the main nozzle unit 14 flows generally axially under the influence of a corner flow A3 and, hence, the circulation region X will not be sufficiently flared radially outwardly. Because of this, the reverse flow region R, which is formed in an axial center portion in the vicinity of the outlet of the fuel nozzle assembly 10, is small. For this reason, the ignitability is lowered.

Figure 5:
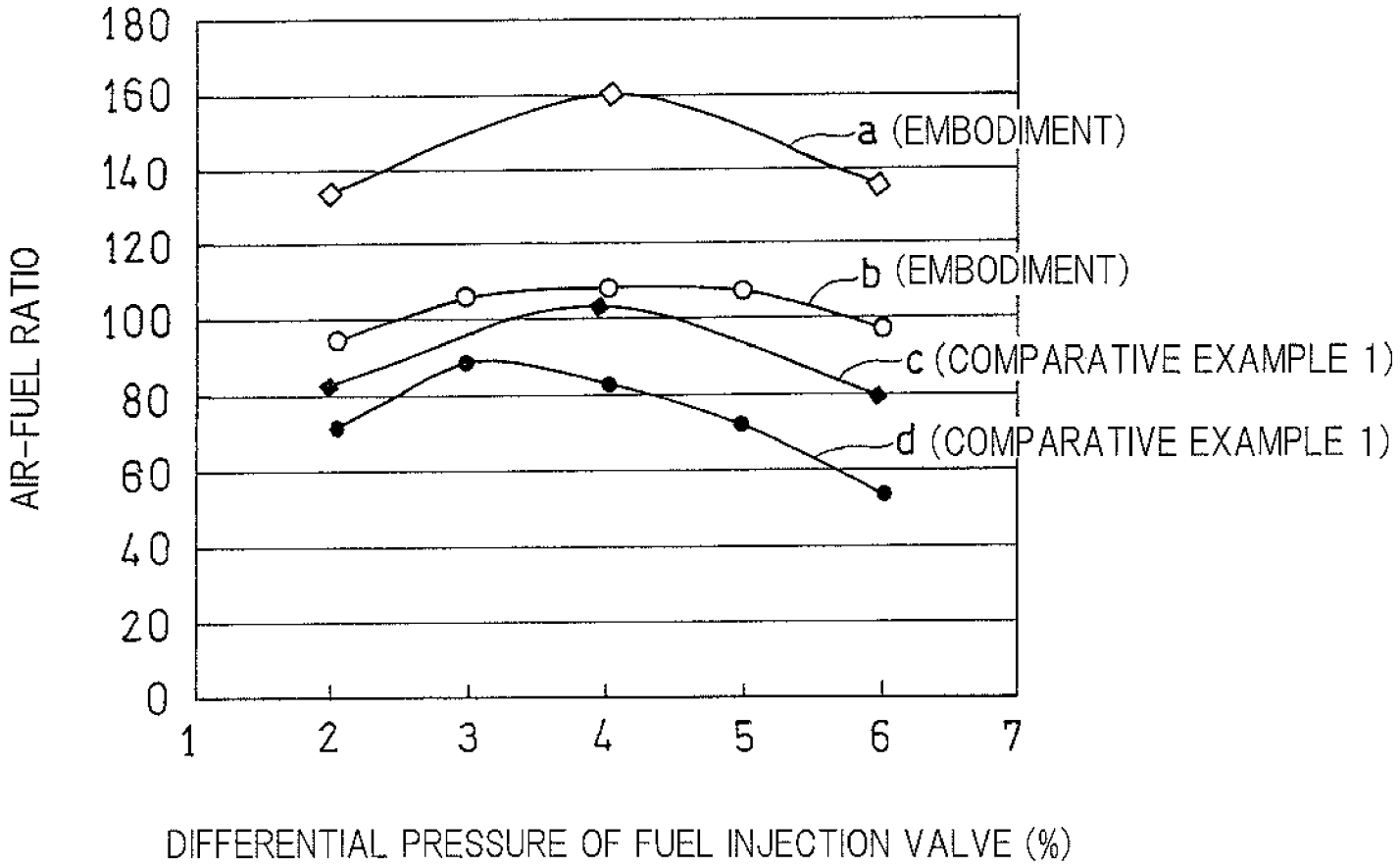
FIG. 5 is a chart showing results of ignition and blowout tests conducted on the combustor.
Figure 6:
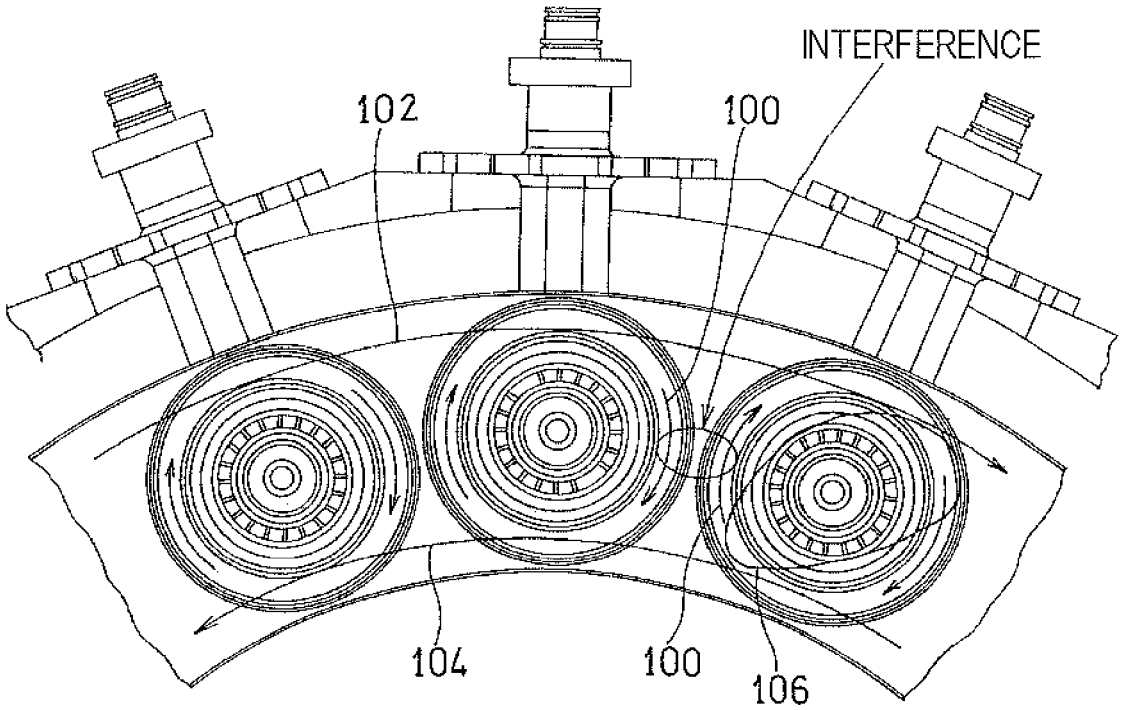
Fig. 6 PRIOR ART
FIG. 6 is a rear view showing an important portion of the combustor.

FIG. 5 is a chart illustrating results of igniting and blow-out tests conducted on the combustor 1, which is designed in accordance with the embodiment of the present invention and is hence each equipped with the flow guide 27, and those tests conducted on a comparative combustor which is not equipped with any flow guide. The axis of abscissas represents the differential pressure (pressure loss) of the fuel nozzle assembly 10 and the axis of ordinates represents the air-fuel mixing ratio. As shown in FIG. 6, the three fuel nozzle assemblies 10 were disposed in an arcuate row. Referring to FIG. 5, a curve "a" represents a blow-out performance of the combustor 1 of the embodiment; a curve "b" represents the blow-out performance of the combustor according to the comparative example 1; a curve "c" represents the igniting performance of the combustor of the embodiment; and a curve "d" represents the igniting performance of the combustor according to the comparative example 1. Over the entire region of the differential pressure represented by the axis of abscissas, both of the air-fuel mixing ratio of the uppermost limit, at which the air-fuel mixture can be ignited, and the air-fuel mixing ratio of the lower limit (the uppermost limit of a stable fuel), at which the blow-out after the ignition occurs, are higher in the combustor 1 of the embodiment, which is equipped with the flow guide 27. Accordingly, it is clear that the use of the flow guide 27 contributes to improvement in both of igniting and blow-off performances.

In the construction described hereinbefore, since as shown in FIG. 3 the flow guide 27 of a type gradually flaring in the downstream direction is mounted on the downstream side of the fuel nozzle assembly 10, the swirling air stream emerging outwardly from the fuel nozzle assembly 10 is directed to flow along the inner peripheral surface of the flow guide 27 and is hence properly flared radially outwardly. Accordingly, as shown in FIG. 2, the circulation region X formed radially inwardly expands radially outwardly with the volume increased. As a result thereof, the spark generated by the ignition plug 16 is quickly captured into the circulation region X to facilitate formation of the flash point. Also, the flow of the air stream along the inner peripheral surface of the flow guide 27 in the manner described above is effective to expand the circulation region X in a direction radially outwardly, accompanied by the increase of the volume. Therefore, the distance between the respective circulation regions of the neighboring fuel nozzle assemblies 10 shown in FIG. 1 is minimized enough to facilitate propagation of the flame, which has been formed in one of the neighboring fuel nozzle assemblies 10, to the other of the neighboring fuel nozzle assemblies 10.

Because of the use of the flow guide 27 best shown in FIG. 2, not only can a possible interference between the swirling air streams emerging respectively from the neighboring fuel nozzle assemblies 10 suppressed, but also massive swirling flows 102 and 104 (both best shown in FIG. 6) will not be formed in an area where the flow guide 27 is provided. Therefore, a stable circulation region X can be formed while both of constriction and deformation of the circulation region X are prevented. In addition, since the air stream is directed to flow along the inner peripheral surface of the flow guide 27, nothing is affected by eddies (corner flows) tending to occur outside of the air stream. Therefore, the stable circulation region X can easily be formed, and as a result thereof, the ignitability is increased.

As best shown in FIG. 3, since the inner diameter D1 of the mounting portion 72 of the upstream end of the flow guide 27 is substantially equal to the air outlet diameter D2 of the fuel nozzle assembly 10, separation of the air, then emerging outwardly from the fuel nozzle assembly 10, from the flow guide 27 can be minimized. Also, when the inner diameter D1 of the mounting portion 72 of the flow guide 27 is chosen to be a value somewhat greater than the air outlet diameter D2 of the fuel nozzle assembly 10, a relative displacement of the fuel nozzle assembly 10 in a radial direction due to the thermal expansion can be absorbed.

Yet, since the flow guide 27 has the conical portion 74 flaring in a conical shape from the upstream side towards the downstream side, the air and the air-fuel mixture from the fuel nozzle assembly 10 can be smoothly guided towards the downstream side. Also, since the angle θ2 of the conical portion 74 relative to the nozzle axis C1 is chosen to be within the range of 25 to 50°, it is possible to prevent the swirling flow from separating from the flow guide 27.

Furthermore, since the flow guide 27 has the cylindrical portion 76 continued from the downstream portion 74*a* of the conical portion 74, an excessive radial expansion of the circulation region X, best shown in FIG. 2, can be suppressed. Hence, the interference between the circulation region X and the swirling flow from the neighboring fuel nozzle assembly 10 can be further suppressed to increase the ignitability.

Since as shown in FIG. 2 the downstream end 74*b* of the conical portion 74 of the flow guide 27 exists to the height of the combustor 1, the air stream considerably expands radially outwardly along the conical portion 74 of the flow guide 27. Therefore, it is possible to expand the circulation region X in the radially outward direction and, as a result thereof, formation of the flash point is further facilitated.

Moreover, since the downstream end 27*b* of the flow guide 27 is positioned at a location upstream of the maximum diameter portion Xa of the circulation region X, propagation of the flame to the circulation region X of the next adjacent fuel nozzle assembly 10 through the maximum diameter portion Xa of the circulation region X can be smoothly facilitated and, hence, the ignitability is further increased.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. By way of example, the flow guide employed in accordance with the present invention is generally applicable to any lean nozzle, in which the amount of air in the nozzle is large, and, therefore, the present invention is not necessarily limited to the nozzle of the shape shown and described in connection with the preferred embodiment of the present invention.

Accordingly, such changes and modifications are, unless they depart from the scope of the present invention as delivered from the claims annexed hereto, to be construed as included therein.

REFERENCE NUMERALS

1 . . . Gas turbine combustor
8 . . . Combustion chamber
10 . . . Fuel nozzle assembly
12 . . . Pilot nozzle unit (First fuel injection unit)
14 . . . Main nozzle unit (Second fuel injection unit)
27 . . . Flow guide
27*a* . . . Upstream end of the flow guide
27*b* . . . Downstream end of the flow guide
34 . . . Pilot outer peripheral nozzle (Spraying nozzle)
74 . . . Conical portion
74*a* . . . Downstream end of the conical portion
76 . . . Cylindrical portion
D1 . . . Inner diameter of the upstream end of the flow guide
D2 . . . Air outlet diameter of the fuel nozzle assembly
H . . . Height of the combustor
X . . . Circulation region
Xa . . . Maximum diameter portion of the circulation region
θ2 . . . Angle of cone of the flow guide

What is claimed is:

1. An annular gas turbine combustor comprising:

one or more fuel nozzle assemblies disposed on a circumference, each fuel nozzle assembly of the one or more fuel nozzle assemblies comprising:

a respective first fuel injection unit configured to spray a first fuel from a respective spraying nozzle into a combustion chamber, a respective second fuel injection unit surrounding each respective first fuel injection unit and configured to spray a second fuel into the combustion chamber, a respective main outlet flare forming a respective outlet, each respective main outlet flare flaring outwardly towards a respective downstream side of each fuel nozzle assembly of the one or more fuel nozzle assemblies, wherein the first fuel and the second fuel are provided to the combustion chamber through each respective main outlet flare; and a respective flow guide mounted on a respective downstream side of each respective second fuel injection unit, each respective flow guide having a respective cross sectional area of a respective passage for an air and an air-fuel mixture from the respective second fuel injection unit, the respective cross sectional area of each flow guide increasing towards a respective downstream side of each flow guide;

wherein the respective flow guide is disposed radially outwardly of the respective main outlet flare, and wherein each flow guide comprises:

a respective annular radially inner portion separated from a respective annular radially outer portion by a respective annular conduit;

each annular radially inner portion and each annular radially outer portion having a respective upstream portion, wherein a respective inner surface of each respective upstream portion is sloped relative to a respective central axis so as to diverge away from the respective central axis in a downstream direction;

each annular radially inner portion and each annular radially outer portion each having a respective downstream portion, wherein a respective inner surface of each respective downstream portion is either sloped less relative to the respective central axis than the respective upstream portion or is at a respective constant distance from the respective central axis.

2. The annular gas turbine combustor as claimed in claim 1, wherein each flow guide has a respective transverse cross sectional shape that is round and has a respective upstream end a respective inner diameter which is equal to or greater than a respective air outlet diameter of the respective second fuel injection unit.

3. The annular gas turbine combustor as claimed in claim 1, wherein the respective upstream portion of each annular radially inner portion and each annular radially outer portion comprises a respective conical portion of a respective shape flared in a respective conical shape from a respective upstream side of the respective second fuel injection unit towards the respective downstream side of the respective second fuel injection unit.

4. The annular gas turbine combustor as claimed in claim 3, wherein a respective angle of each conical portion relative to each respective central axis is between 25 and 50 degrees.

5. The annular gas turbine combustor as claimed in claim 3, wherein the respective downstream portion of each annular radially inner portion and each annular radially outer portion comprises a respective cylindrical portion continued with a respective downstream end of the respective conical portion.

6. The annular gas turbine combustor as claimed in claim 3, wherein each conical portion a respective downstream end, and a respective outer diameter of the respective downstream end each conical portion is greater than or equal to 0.9HL where H represents a radial width of the combustion chamber that is formed inside of the combustor.

7. The annular gas turbine combustor as claimed in claim 1, wherein each flow guide has a respective downstream end positioned at a location upstream of a maximum diameter portion of a circulation region of the combustion chamber.

8. The annular gas turbine combustor as claimed in claim 1, wherein a respective outer diameter of a respective downstream end of each flow guide is greater than or equal to 0.9H, where H represents a radial width of the combustion chamber.

* * * * *